US009505596B2

(12) United States Patent
Campbell et al.

(10) Patent No.: US 9,505,596 B2
(45) Date of Patent: Nov. 29, 2016

(54) MAST LIFT WITH SCREW DRIVE AND GAS STRUT

(71) Applicant: JLG Industries, Inc., McConnellsburg, PA (US)

(72) Inventors: Geoffrey George Campbell, Kensington (AU); Jason James Watson, Matraville (AU); Mark Nathan Spaile, Little Bay (AU)

(73) Assignee: JLG INDUSTRIES, INC., McConnellsburg, PA (US)

( * ) Notice: Subject to any disclaimer, the term of this patent is extended or adjusted under 35 U.S.C. 154(b) by 56 days.

(21) Appl. No.: 14/338,906

(22) Filed: Jul. 23, 2014

(65) Prior Publication Data

US 2014/0332317 A1 Nov. 13, 2014

Related U.S. Application Data

(63) Continuation-in-part of application No. 13/191,676, filed on Jul. 27, 2011, now Pat. No. 8,789,654.

(60) Provisional application No. 61/374,368, filed on Aug. 17, 2010.

(51) Int. Cl.
*B66F 11/04* (2006.01)
*E04G 1/22* (2006.01)

(52) U.S. Cl.
CPC *B66F 11/04* (2013.01); *E04G 1/22* (2013.01)

(58) Field of Classification Search
CPC ..... B66F 11/04; B66F 11/046; E04G 1/22
See application file for complete search history.

(56) References Cited

U.S. PATENT DOCUMENTS

| | | | | |
|---|---|---|---|---|
| 1,342,828 | A | 12/1915 | Seymour | |
| 2,676,677 | A | 4/1954 | Anderson et al. | |
| 2,762,659 | A | 9/1956 | Harlan et al. | |
| 2,948,363 | A | 8/1960 | Hopfeld | |
| 3,404,752 | A * | 10/1968 | Deines | E04G 1/22 182/148 |
| 3,871,478 | A | 3/1975 | Bushnell, Jr. | |

(Continued)

FOREIGN PATENT DOCUMENTS

| | | |
|---|---|---|
| DE | 85 05 465 | 4/1985 |
| EP | 0 096 208 | 12/1983 |

(Continued)

OTHER PUBLICATIONS

European Examination Report dated Jul. 20, 2015 issued in European Patent Application No. 11177697.7, 5 pp.

(Continued)

*Primary Examiner* — Colleen M Chavchavadze
(74) *Attorney, Agent, or Firm* — Nixon & Vanderhye P.C.

(57) ABSTRACT

A mast lift includes a base and a telescoping mast coupled with the base and extending upward from the base. The telescoping mast has a support section fixed to the base and a movable section movably connected and displaceable relative to the support section between a retracted position and an extended position. A top cap is secured to the movable section, and a platform is supported by the top cap and the movable section. A gas strut acts between the support section and the movable section and biases the movable section toward the extended position. A threaded driving rod is connected between the top cap and the base and extends through a fixed nut assembly.

7 Claims, 13 Drawing Sheets

(56) References Cited

U.S. PATENT DOCUMENTS

| | | | | |
|---|---|---|---|---|
| 3,876,039 | A | 4/1975 | Bushnell, Jr. | |
| RE28,455 | E * | 7/1975 | Denier | B66F 3/22 182/148 |
| 4,258,825 | A | 3/1981 | Collins | |
| 4,427,093 | A | 1/1984 | Wehmeyer et al. | |
| 4,427,094 | A | 1/1984 | Winkelblech | |
| 4,458,786 | A | 7/1984 | Lebre | |
| 4,575,976 | A * | 3/1986 | McDermott | B66F 11/046 212/349 |
| 4,592,447 | A | 6/1986 | Ream et al. | |
| 4,752,102 | A | 6/1988 | Rasmussen | |
| 4,875,555 | A | 10/1989 | Johansson et al. | |
| 4,987,976 | A | 1/1991 | Daugherty | |
| 5,044,473 | A | 9/1991 | Gripe | |
| 5,111,907 | A | 5/1992 | Kishi | |
| 5,143,181 | A | 9/1992 | Bixby | |
| 5,203,425 | A | 4/1993 | Wehmeyer | |
| 5,273,132 | A | 12/1993 | Sasaki et al. | |
| 5,425,433 | A | 6/1995 | Huber | |
| 5,427,197 | A | 6/1995 | Waters | |
| 5,624,046 | A | 4/1997 | Zimmermann | |
| 5,636,705 | A | 6/1997 | St. Germain | |
| 5,755,306 | A | 5/1998 | Kraemer et al. | |
| 5,803,204 | A | 9/1998 | White et al. | |
| 5,850,892 | A | 12/1998 | Citron et al. | |
| 5,890,559 | A | 4/1999 | Busuttil et al. | |
| 6,041,491 | A | 3/2000 | Ishikawa et al. | |
| 6,174,124 | B1 | 1/2001 | Haverfield et al. | |
| 6,206,059 | B1 | 3/2001 | Maakad et al. | |
| 6,299,336 | B1 | 10/2001 | Hulse | |
| 6,401,864 | B1 | 6/2002 | Stringer et al. | |
| 6,471,004 | B2 | 10/2002 | Stringer et al. | |
| D570,071 | S | 5/2008 | Campbell et al. | |
| 7,497,140 | B2 | 3/2009 | Blackwelder et al. | |
| 7,614,459 | B2 | 11/2009 | Campbell et al. | |
| 7,762,532 | B2 | 7/2010 | Campbell et al. | |
| 7,766,750 | B2 | 8/2010 | Campbell et al. | |
| 7,896,366 | B2 | 3/2011 | Campbell et al. | |
| 8,292,039 | B2 * | 10/2012 | Campbell | B66F 17/006 182/142 |
| 2007/0125599 | A1 | 6/2007 | Campbell et al. | |
| 2008/0314690 | A1 | 12/2008 | Campbell et al. | |

FOREIGN PATENT DOCUMENTS

| | | |
|---|---|---|
| EP | 0 273 888 | 7/1988 |
| JP | 57-46577 | 9/1955 |
| JP | 49-104354 | 10/1974 |
| JP | 63-168160 | 7/1988 |
| JP | 2-4900 | 1/1990 |
| JP | 2-159404 | 6/1990 |
| JP | 2-107337 | 8/1990 |
| JP | 3-100289 | 10/1991 |
| JP | 4-366050 | 12/1992 |
| JP | 5-69079 | 9/1993 |
| JP | 6-340398 | 12/1994 |
| JP | 9-151088 | 6/1997 |
| JP | 10-36087 | 2/1998 |
| JP | 2000-153995 | 6/2000 |
| JP | 3166610 | 3/2001 |
| JP | 2003-327393 | 11/2003 |
| JP | 2006-264797 | 10/2006 |
| JP | 2007-39227 | 2/2007 |

OTHER PUBLICATIONS

Japanese Office Action dated Jan. 6, 2015 issued in Japanese Patent Application No. 2013-524956 and English translation, 7 pp.

Japanese Office Action dated Feb. 14, 2013 issued in Japanese Patent Application No. 2011-178048 and English translation, 6 pp.

Japanese Office Action dated Dec. 3, 2013 issued in Japanese Patent Application No. 2011-178048 and English Translation, 4 pp.

Japanese Office Action mailed Feb. 25, 2014 issued in Japanese Patent Application No. 2013-524956 and English Translation, 10 pp.

* cited by examiner

MAST LIFT WITH SCREW DRIVE AND GAS STRUT

CROSS-REFERENCES TO RELATED APPLICATIONS

This application is a continuation-in-part (CIP) of U.S. patent application Ser. No. 13/191,676, filed Jul. 27, 2011, pending, which claims the benefit of U.S. Provisional Patent Application No. 61/374,368, filed Aug. 17, 2010, the entire contents of each of which are hereby incorporated by reference in this application.

STATEMENT REGARDING FEDERALLY SPONSORED RESEARCH OR DEVELOPMENT (Not Applicable)

BACKGROUND OF THE INVENTION

The present invention relates to a personnel lift and, more particularly, to a portable lift machine including a work platform raised and lowered by a lifting system. The LiftPod® system by JLG Industries, Inc. has been described in U.S. patent application Ser. Nos. 10/594,666, 11/581,785, 12/190,217, 12/293,759, U.S. Pat. Nos. D570,071, 7,614,459, 7,762,532, and 7,766,750. See also www.LiftPod.com. The contents of the referenced documents and website are incorporated by reference.

The ladder concept is several thousand years old. Existing ladders, however, can be cumbersome and difficult to maneuver. Additionally, conventional ladders can be unstable particularly on uneven ground, and a work area is limited to the user's reach.

Ladder companies are reluctant to develop powered mechanical products. It would be desirable, however, to develop a personnel lift that achieves many of the advantages of a ladder, e.g., can be set up and used by a single operator, lightweight, etc., while providing for greater stability and a larger working area in a portable powered machine Mast climbing platforms are known and typically include a mast that can be free-standing or supported by a wall or other support structure. However, existing mast climbers have minimum SWL loads of 1000 lbs and are not portable or operable by a single user due at least to their size. Vertical mast products and aerial work platforms include a moving platform and generally are also typically too large for portability and are very far from the many advantages provided by a ladder in terms of portability, low cost and ease of use.

To achieve portability, a light weight, reliable lift system mechanism is desirable to provide the functionality expected of a device which lifts personnel.

BRIEF SUMMARY OF THE INVENTION

A desirable feature of the LiftPod system is its low weight and portability. A single operator can assemble the unit. The portable construction enables the single operator to carry it up stairs, load the unit in a truck bed, etc. The system incorporates a full platform with rails around the operator for security. Lift power can be provided via a cordless drill or a dedicated power pack.

The invention embodies a personnel lift system that is smaller in construction than the original LiftPod® system.

The invention can serve as an alternative to step ladders (up to 1.8 m/6 ft.) and can incorporate extensions to achieve higher reach.

Gas struts may be provided to store energy in the lowered position and thereby reduce power requirements for the lift. The gas strut in combination with a screw thread (such as an acme screw) and cordless DC motor/battery can provide both the means to power and control the machine to lift and lower a person in the platform in a secure manner.

In an exemplary embodiment, a mast lift includes a base and a telescoping mast coupled with the base and extending upward from the base. The telescoping mast has a support section fixed to the base and a movable section movably connected to and displaceable relative to the support section between a retracted position and an extended position. A top cap is secured to the movable section, and a platform is supported by the top cap and the movable section. A gas strut acts between the support section and the movable section and biases the movable section toward the extended position. A threaded driving rod is connected between the top cap and the base and extends through a fixed nut assembly.

The gas strut may be secured to the base. The mast lift may additionally include a drive link coupled with the threaded driving rod that receives a rotary power source to rotate the threaded driving rod. The drive link may comprise a socket for receiving a complementary bit of a hand-held power drill. The fixed nut assembly may include a housing secured to the gas strut and a nut disposed in the housing, where the threaded driving rod may be threaded through the nut. The telescoping mast may additionally include a middle section cooperable with the support section and the movable section. In this context, the mast lift may further include a second gas strut and a second threaded driving rod that are configured to displace the middle section relative to the support section.

In another exemplary embodiment, a mast lift includes a base and a telescoping mast coupled with the base and extending upward from the base. The telescoping mast includes a support section fixed to the base, a middle section displaceable relative to the support section, and a top section displaceable relative to the support section and the middle section. A top cap is secured to the top section, and a platform supported by the top cap and the top section. A gear box is secured to the middle section. A first gas strut is secured at one end to the middle section and acts between the middle section and the top section and biases the top section toward an extended position. A first threaded driving rod is connected between the top cap and the middle section and extends through a first fixed nut assembly. A second gas strut may be secured between the gear box and the support section, and a second threaded driving rod may be connected between the gear box and the base and extending through a second fixed nut assembly. The second threaded driving rod may be fixed to the second gas strut. The gear box may include a power transfer belt connected between the first threaded driving rod and the second threaded driving rod, where the first threaded driving rod is configured such that when the first threaded driving rod reaches a maximum extended position, the rotary power is transferred to the second threaded driving rod by the power transfer belt.

In yet another exemplary embodiment, a multi-section mast lift includes a base; a telescoping mast supported on the base, the telescoping mast including a support section secured to the base, at least one middle section cooperable with the support section and displaceable relative to the support section between a retracted position and an extended position, and a top section cooperable with a topmost one of the at least one middle section and displaceable relative to the topmost one of the least one middle section between a retracted position and an extended position; a top cap secured to the top section; a platform supported by the top cap and the top section; a gear box secured to the at least one middle section; and a lifting assembly for displacing the top section and the at least one middle section between the retracted and extended positions, the lifting assembly including a threaded driving rod and a gas strut for each of the top section and the at least one middle section, wherein the threaded driving rods are driven by rotating a single drive link cooperable with the lifting assembly.

BRIEF DESCRIPTION OF THE DRAWINGS

These and other aspects of the invention will be described in detail with reference to the accompanying drawings, in which.

DETAILED DESCRIPTION OF THE INVENTION

Figure 2:
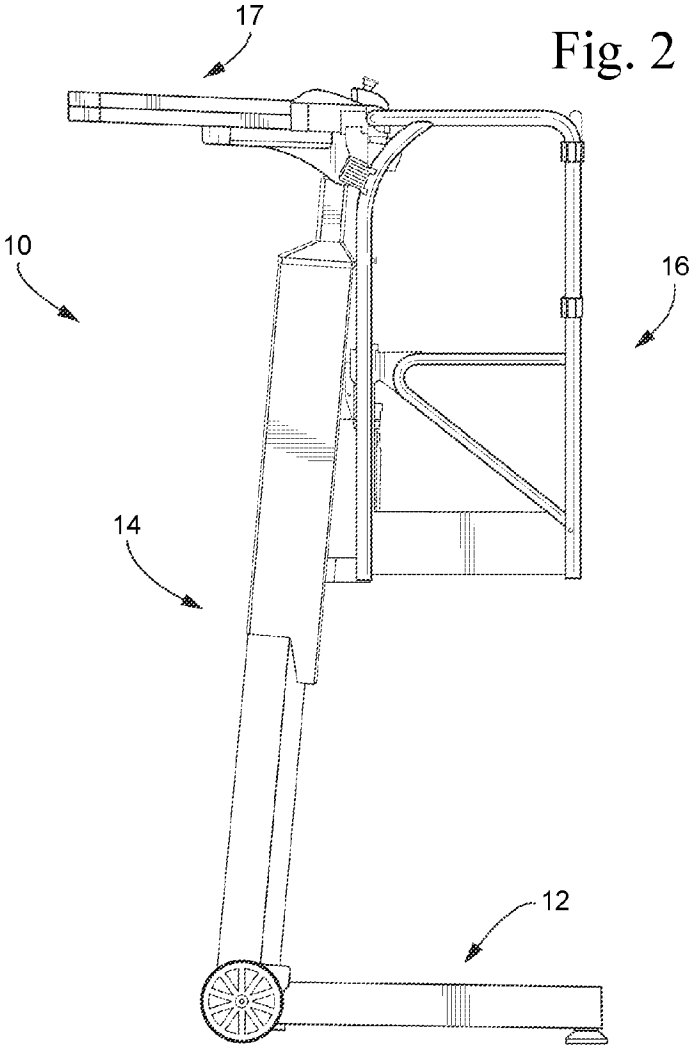
FIG. 2 is a side view of the assembled mast lift with the platform in a raised position.
Figure 1:
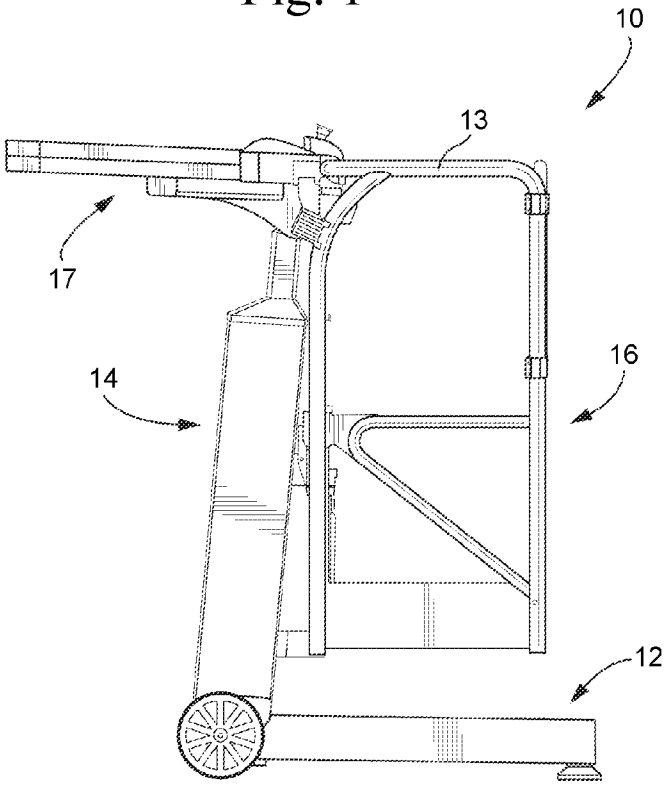
FIG. 1 is a side view of the assembled mast lift with the platform in a lowered position.

With reference to FIGS. 1-4, a mast lift 10 includes a base 12 and a telescoping mast 14 coupled with the base 12 and extending upward from the base 12. A platform 16 is secured to a movable section of the telescoping mast 14. A lifting assembly is connected between the base 12 and the platform 16 and moves the platform 16 between a lowered position (FIG. 1) and a raised position (FIG. 2). The platform 16 includes a safety rail 13 and a gate 15. Additionally, an accessory tray 17 may be connected to the platform 16. Other or alternative accessory items may be attached. For example, the design can be customized with specific accessories for a specific user purpose, i.e., the machine may designed such that it can accommodate a number of accessories specific to user requirements, including tool trays, buckets, drawers, paint trays, cleaning, and other accessories. These accessories may be attached to the mast, base or platform.

The telescoping mast 14 is provided with a support section 18 fixed to the base 12 and a movable section 20 movably connected to and displaceable relative to the support section 18 between a retracted position (lowered position shown in FIG. 1) and an extended position (raised position shown in FIG. 2). The platform 16 is secured to the movable section 20 of the mast 14.

Figure 3:
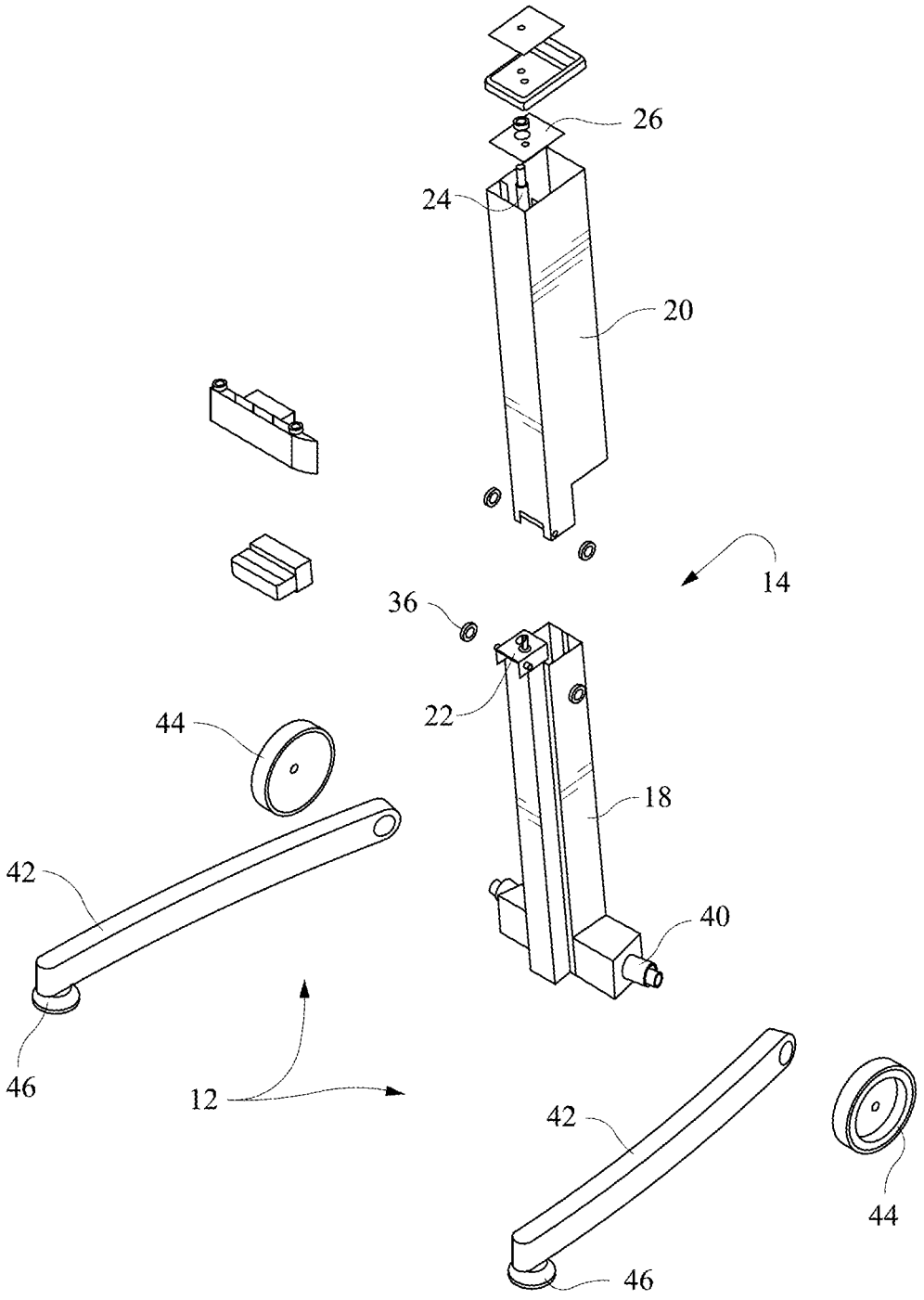
FIGS. 3 and 4 are exploded views showing parts of the mast lift.
Figure 4:
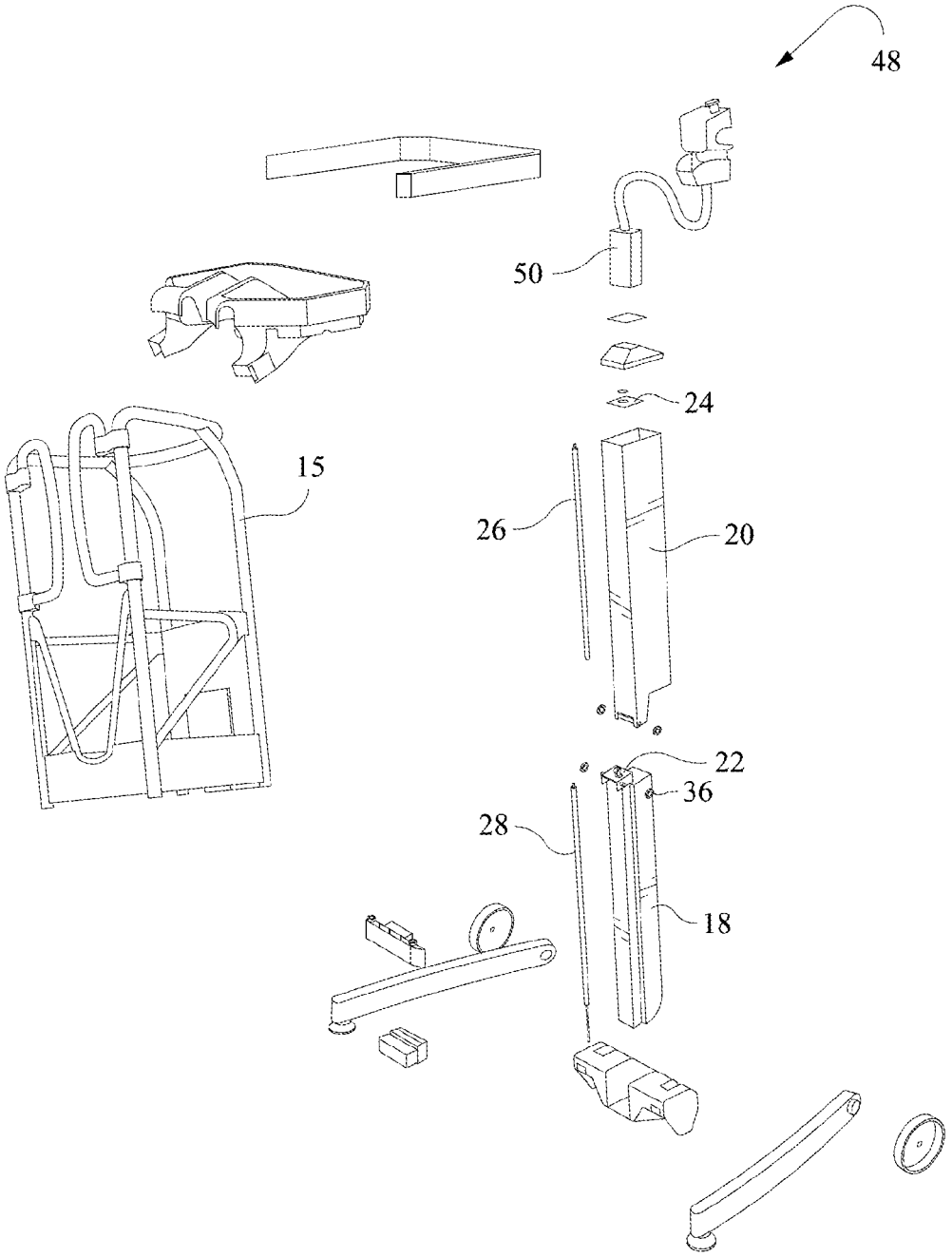

With reference to FIGS. 3 and 4, a first driving plate 22 is secured to the support section 18, and a second driving plate 24 is secured to the movable section 20. A threaded driving rod 26 (such as an acme screw) is connected between the first driving plate 22 and the second driving plate 24. That is, the threaded driving rod 26 is fixed to one of the first and second driving plates 22, 24 and is movably threaded in an opening in the other of the first and second driving plates 22, 24. In a preferred arrangement, the first driving plate 22 secured to the support section 18 includes the threaded opening or a bolt opening through which the threaded driving rod is movable by rotating the threaded driving rod 26. In this preferred arrangement, the rod 26 is fixed to the second driving plate 24 in the movable section 20 of the telescoping mast 14.

Those of ordinary skill in the art will appreciate alternative configurations for the drive construction, and the invention is not necessarily meant to be limited to the described and illustrated examples. For example, an alternative configuration could fix the threaded rod rotationally and drive the nut/threaded hole. In this context, the thread can be fixed to the lower section of the mast, whilst the nut is rotated and drives the machine up. The thread could similarly be fixed to the top section whilst driving the nut. To drive the nut, it may simply be a hollow tube with the drive shaft connected on top for matching to the drill/power pack.

A gas strut 28 acts between the support section 18 and the movable section 20 and is configured to bias the movable section 20 toward the extended position (platform raised position—FIG. 2). The gas strut 28 stores energy in the lowered position to thereby reduce the power requirements for the lift.

Figure 5:
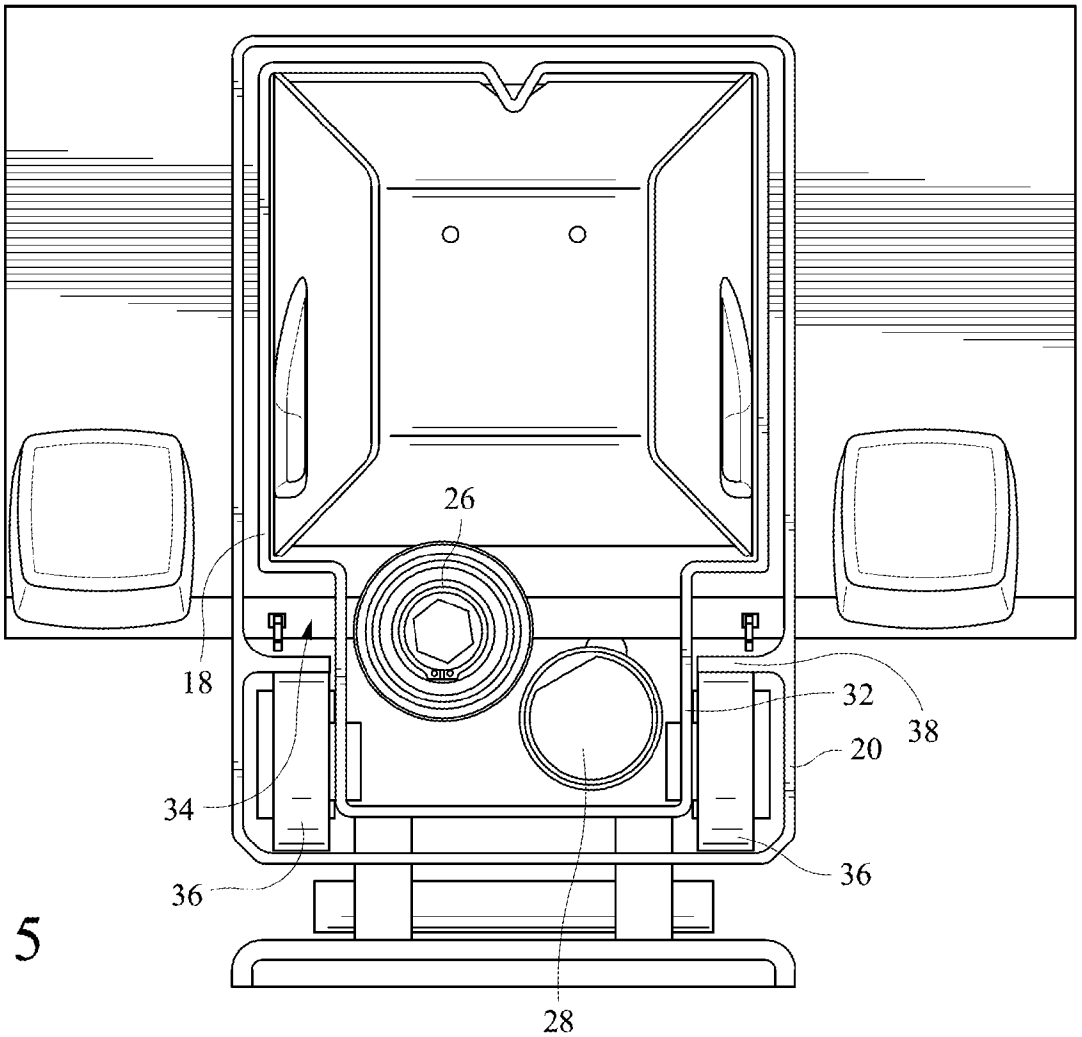
FIG. 5 is a top plan view looking into the telescoping mast.

With reference to FIGS. 3-5, in a preferred construction, an inside perimeter of the movable section 20 is larger than an outside perimeter of the support section 18, and the movable section 20 is disposed over the support section 18. As shown in FIG. 5, the outside perimeter of the support section 18 may be substantially T-shaped, including a head section 30 and a leg section 32. In this arrangement, the threaded driving rod 26 and the gas strut 28 are disposed generally in the leg section 32 of the T-shape. The T-shaped perimeter of the support section 18 defines respective bearing spaces 34 on opposite sides of the leg section 32. Bearings 36 are secured to each side of the support section 18 in the bearing spaces 34, respectively. The movable section 20 may be provided with a bearing guide 38 extending inward into each of the bearing spaces 34 on opposite sides of the leg section 32 of the support section 18. The bearings 36 are positioned between the bearing guides 38 and an outer wall of the movable section 20 as shown in FIG. 5.

With reference to FIG. 3, the base includes an axle 40 to which the support section 18 is connected. A pair of base legs 42 are secured to the axle 40 on opposite sides of the support section 18. The axle 40 extends through openings in the base legs 42. A pair of wheels 44 are respectively secured to the axle 40 on opposite sides of the support member 18 and through the base legs 42. Supporting feet 46 are disposed on ends of the base legs 42 opposite from the axle 40.

As shown in FIG. 4, the mast lift may additionally include a power pack 48 that is coupled with the threaded driving rod 26. The power pack includes a rotatable socket assembly 50 fixed at one end to the threaded driving rod 26 and is powered by a motor/gearbox assembly located inside the power pack 50. Alternatively, a user can power the device using a rotary drive source such as a hand-held power drill or the like by engaging the drill or a socket to the top of the drive shaft 26.

In use, with the mast lift 10 in a lowered position (FIG. 1), an operator can enter the platform 16 via the gate 15. The operator engages a hand-held power drill with the power pack 48 to drive the threaded driving rod 26. As the rod 26 is rotated, the rod 26 is displaced relative to the first driving plate 22 secured to the support section 18 of the telescoping mast 14. Since the opposite end of the rod 26 is fixed to the movable section 20 of the mast 14 via the second driving plate 24, the movable section 20 moves with the driving rod 26 and telescopes over the support section 18 toward the raised position (FIG. 2). The gas strut 28 assists in lifting the platform to thereby reduce power requirements for the lift. The platform 16 can be stopped in any position between the lowered position (FIG. 1) and the raised position (FIG. 2). Safeguards are provided to alert the operator when the platform has reached the maximum raised position. To lower the platform, the operation is reversed by reversing rotation of the threaded driving rod 26. The weight of the platform 16 and the operator is sufficient to contract the gas strut 28 without impeding the operator's ability to efficiently lower the platform 16.

Figure 6:
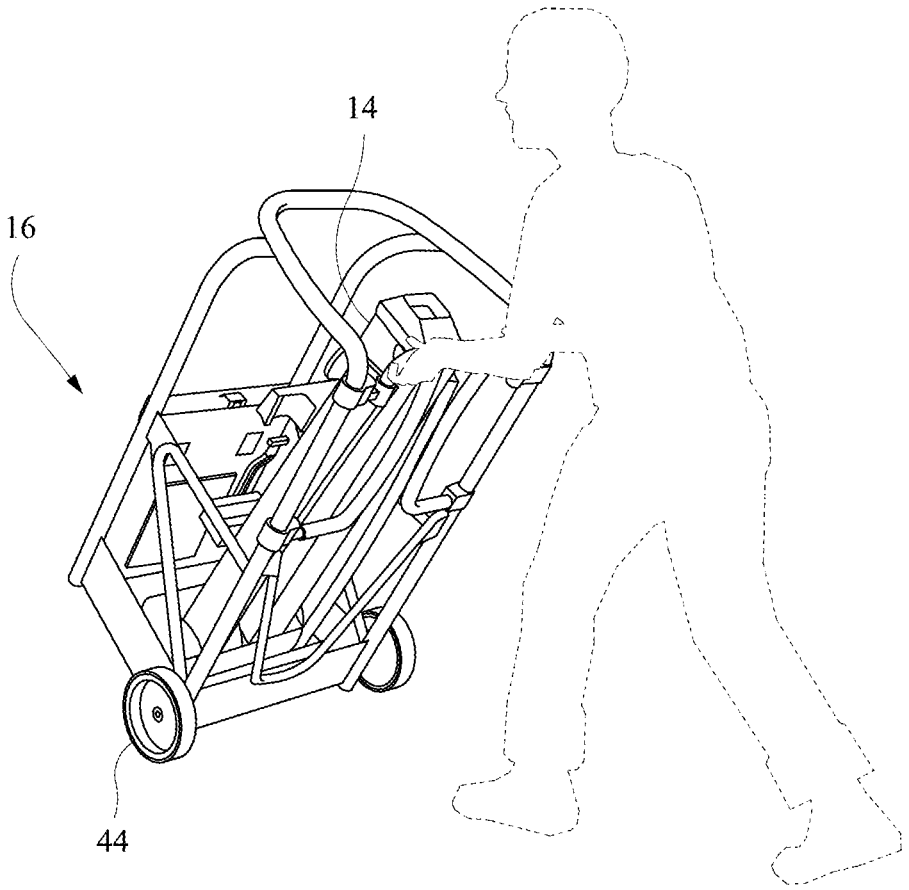
FIG. 6 shows a transport configuration of the mast lift.

The mast lift 10 is easily transported by a single user. For additional portability, the wheels 44 can be removed and placed onto the platform as shown in FIG. 6. The mast/base may also collapse and fit into the platform. With the wheels on the platform and the mast in the platform, the machine is even more transportable and can be used to cart tools etc. In addition, the mast lift may be provided with a self-propel attachment including powered wheels attachable adjacent a front end of the base 12. The self-propel attachment may be engaged and controlled by a user on the platform 16.

Figure 9:
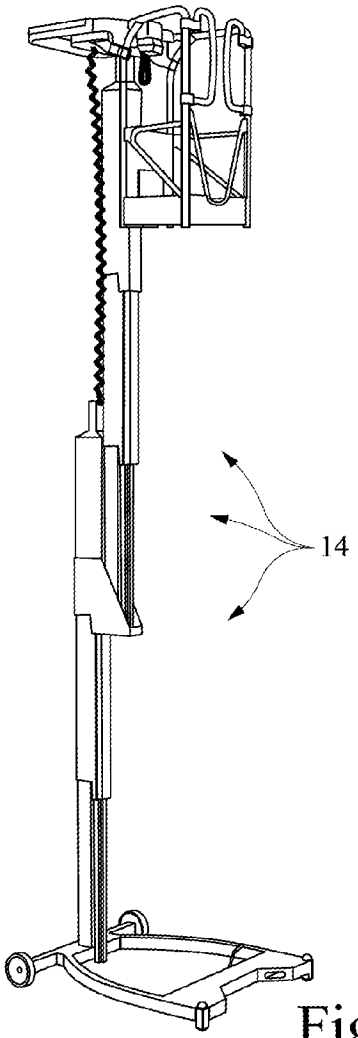
FIGS. 7-9 show alternative constructions utilizing modified mast components.
Figure 8:
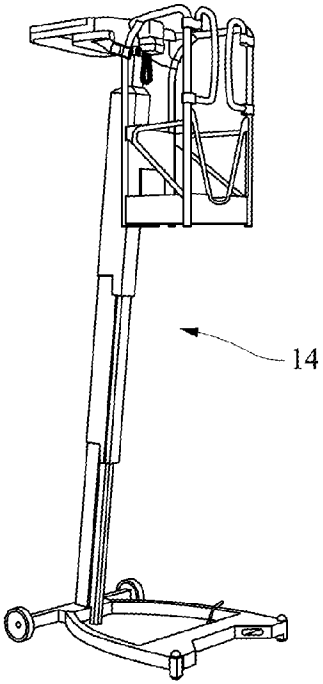
Figure 7:
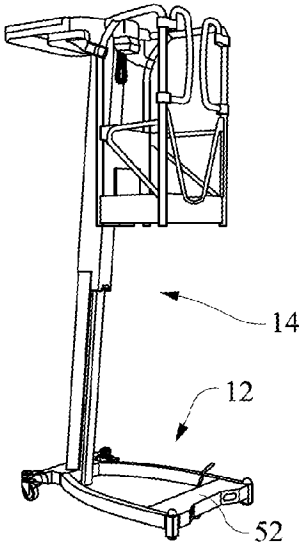

The maximum reach of the lift can be extended through the use of a longer support section 18 and movable section 20. Alternatively or additionally, the mast 14 may include one or more additional sections cooperable with the support section 18 and movable section 20. For example, see FIGS. 7-9 showing 6 ft, 8 ft and 14 ft versions, respectively, using modified mast sections. In some arrangements, the base 12 may also be modified to accommodate added support requirements. The 6 ft version is an extended version of the mast and drive used on the 4 ft version, but the bottom of the lower mast is hollow and matches to the square base stump. The 6 ft version thus does not have the "T" as described for the 4 ft, but is a hollow mast end. Additionally, the base 12 includes a cross member 52 connecting the legs of the base 12 as shown in FIG. 7. The 8 ft and 14 ft versions utilize a three-stage telescopic mast, which includes a telescopic acme drive.

FIGS. 13-18 are sectional views of the lift mechanism operating components. The assembly shown in FIGS. 13-18 corresponds to a three-section lift. The mast lift of course may include two sections or more than three sections, and the invention is not meant to be limited to the described exemplary application.

In the exemplary three-section lift, the lift mechanism includes a first threaded driving rod 26-1 acting between an outer section 54 and a middle section 56 and a second threaded driving rod 26-2 acting between the middle section 56 and the support (inner) section 58. The assembly also includes a first gas strut 28-1 cooperating with the first threaded driving rod 26-1 and a second gas strut 28-2 cooperating with the second threaded driving rod 26-2. Cylinders 29 house the driving rods when the mast is in a retracted position. The cylinders 29 keep the rods from hitting other objects within the mast when retracting, and they also house grease to keep the rods lubricated.

A top cap 60 is secured, e.g., bolted, to the outer section 54 and supports the platform 16 and operator. A gear box 62 is secured to the middle section 56 via a bolted connection or the like. The first threaded driving rod 26-1 is fixed or anchored to the middle section 56 within the gearbox 62. A guide tube 63 surrounds the first threaded driving rod 26-1 and is supported via a guide 64 (clearance fit). The first threaded driving rod 26-1 extends through a corresponding first fixed nut assembly 66. The nut assembly 66 preferably includes a nut housing 67, a primary nut 68 and a safety nut 70. As the first threaded driving rod 26-1 is rotated in the fixed nut 68, the threaded driving rod 26-1 is displaced relative to the nut 68 (depending on the direction of rotation). The safety nut 70 acts as a back-up in the event that the primary nut 68 fails.

A drive link 72 receives a rotary power source such as a hand-held power drill or the like to rotate the threaded driving rod 26-1 through a set of gears 73. In a preferred arrangement, the drive link 72 is a socket for receiving a complementary bit of the hand-held power drill.

Figure 16:
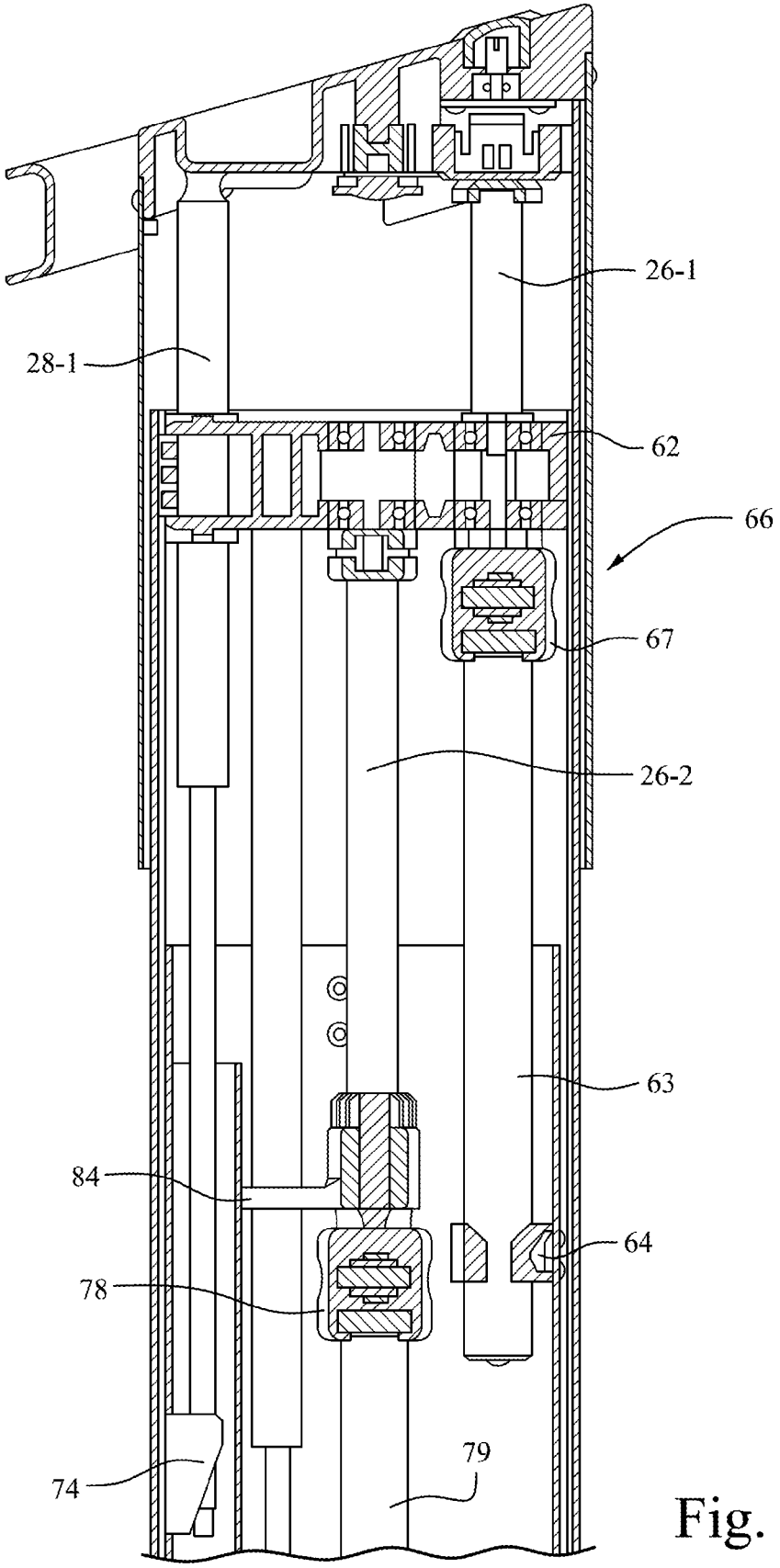
Figure 17:
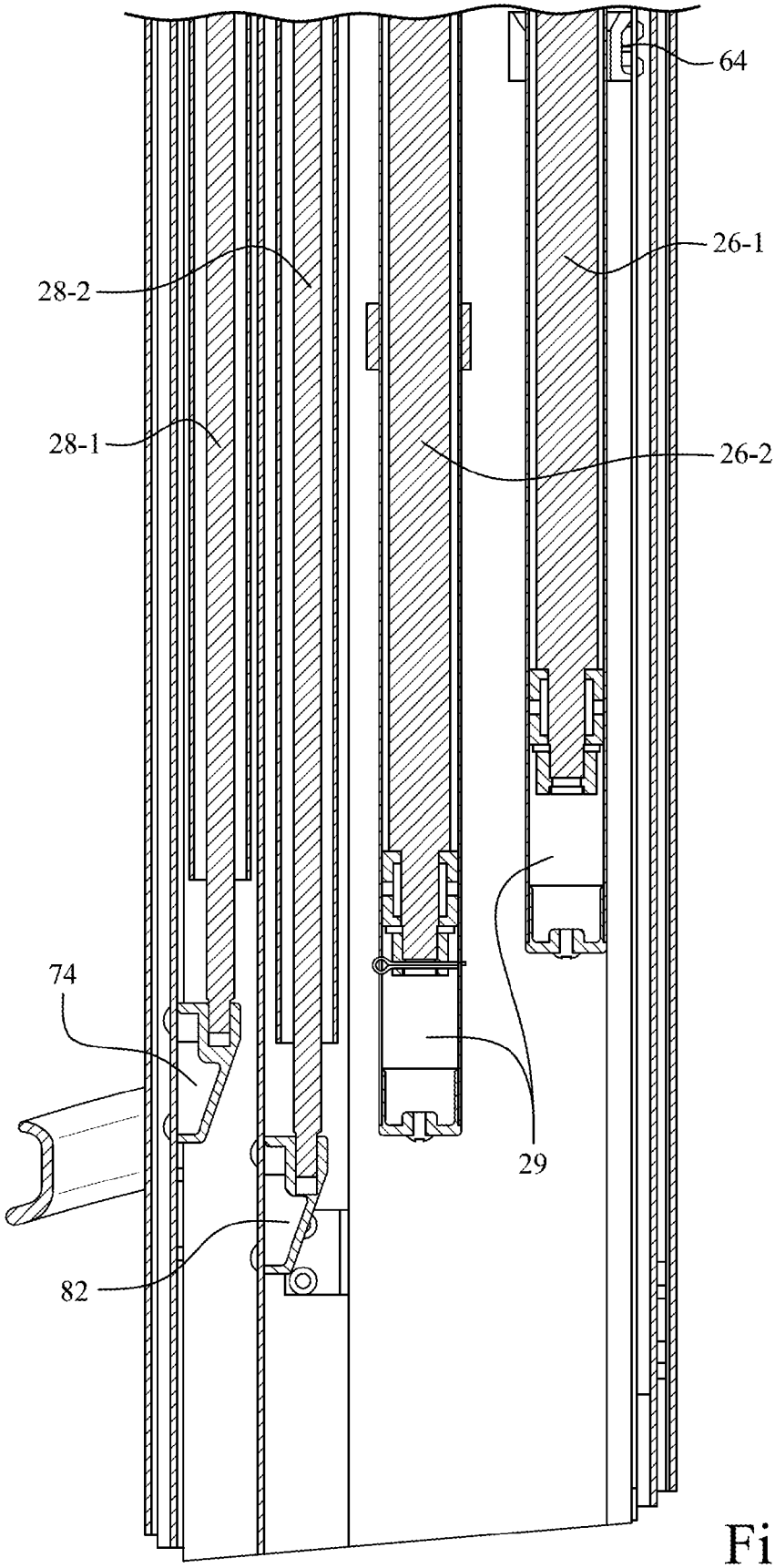
Figure 18:
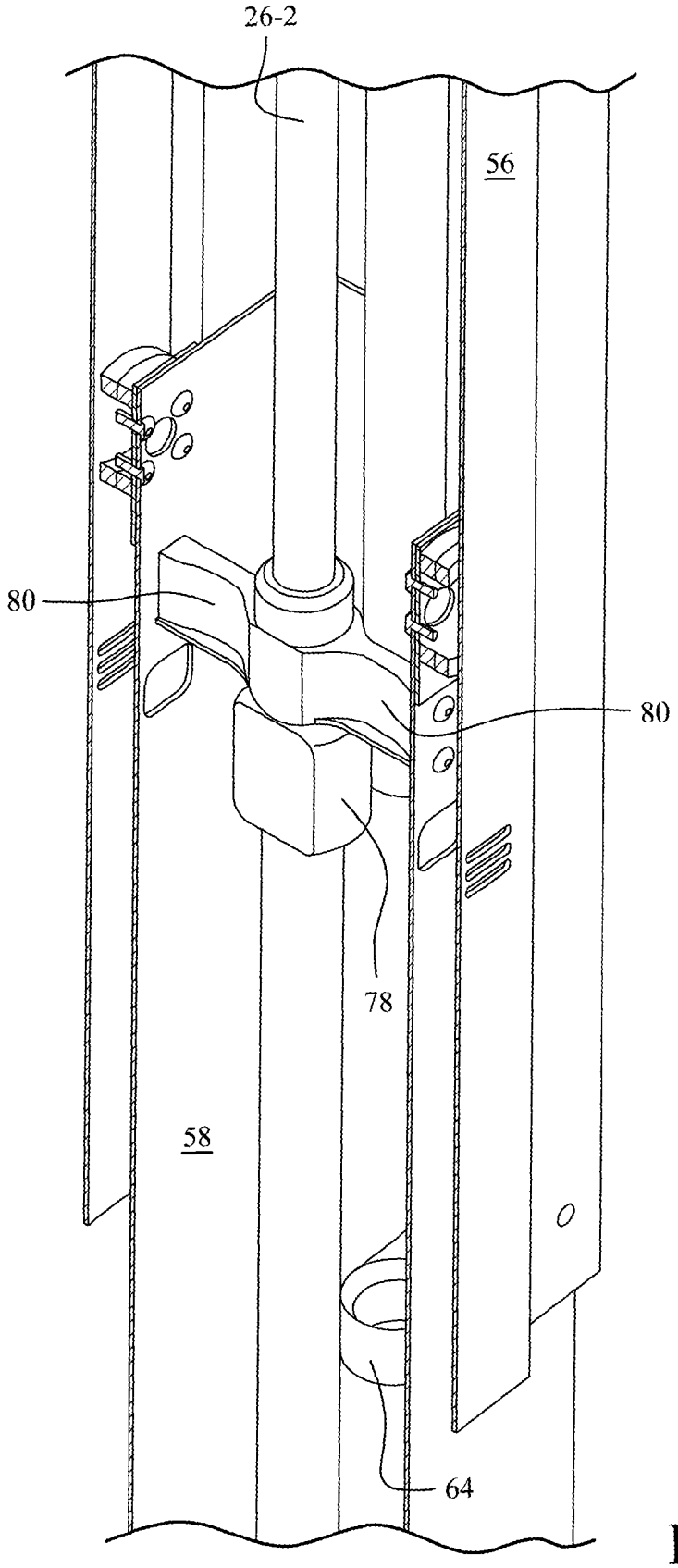

The first gas strut 28-1 is anchored to the middle section 56 via a suitable connector 74 (see FIGS. 16-17). As discussed previously, the gas strut 28-1 is biased to assist the first threaded driving rod 26-1 to lift or extend the outer section 54 relative to the middle section 56.

Figure 15:
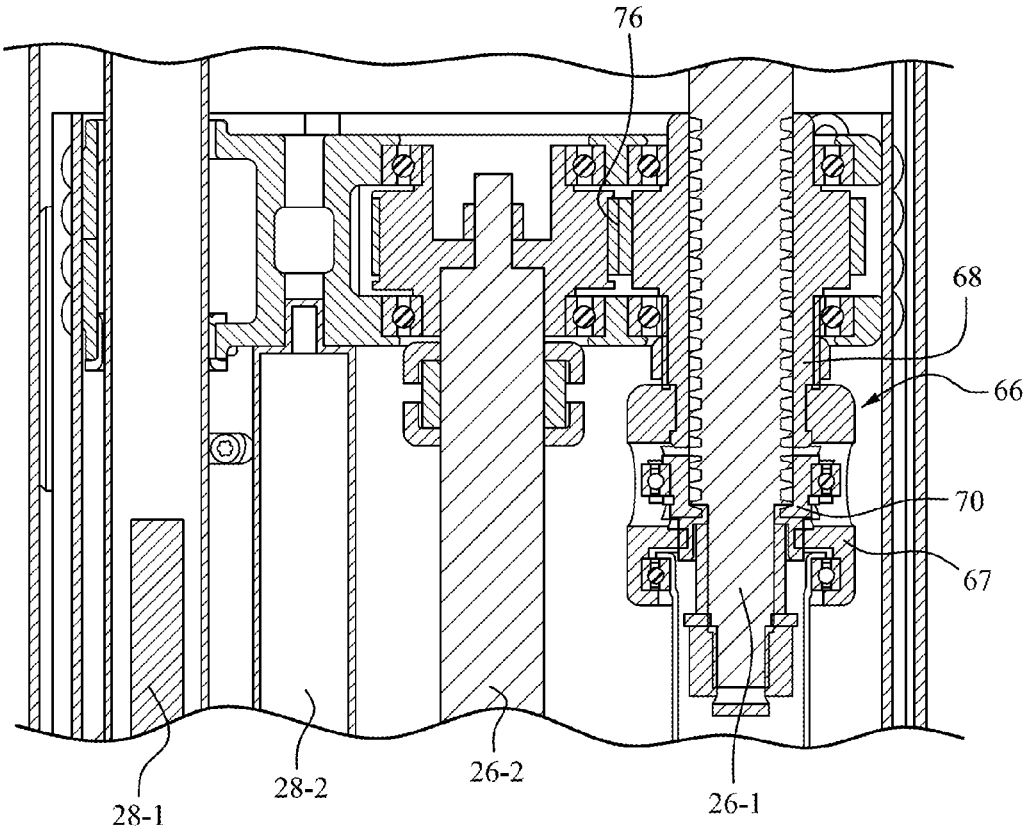

With reference to FIG. 15, the gear box 62 includes a power transfer belt 76 connected between the first threaded driving rod 26-1 and the second threaded driving rod 26-2. When the friction between the primary nut 68 and the first threaded driving rod 26-1 is greater than the friction between the primary nut of a second fixed nut assembly 78 (described below) and the second threaded driving rod 26-2, power is transferred to the second threaded driving rod 26-2 by the drive belt 76. This takes place according to the path of least resistance, although it is typical that one section will fully extend or retract before power is transferred to the other driving rod. The extension or retraction of the mast sections is not timed (i.e., can be random) due to the system relying on the path of least resistance.

The second threaded driving rod 26-2 is connected between the gear box 62 and the support section 58. A guide tube 79 surrounds the second threaded driving rod 26-2. As noted, the support section 58 is secured with the base, and the second threaded driving rod 26-2 is effectively anchored to the base through the support section 58. That is, the load is transferred from the second threaded driving rod 26-2 to the second fixed nut assembly 78, from the second fixed nut assembly 78 to the support section 58 via a bolted connection 80 (see FIG. 18), and from the support section 58 to the base. The second gas strut 28-2 is similarly secured between the gear box 62 and the base via the support section 58 and a connector 82. The second threaded driving rod 26-2 extends through the second fixed nut assembly 78. The second fixed nut assembly 78 is constructed generally corresponding to the first fixed nut assembly 66. An arm and guide 84 is connected with the second gas strut 28-2 and acts as a guide for the gas strut 28-2. The arm and guide 80 prevents the gas strut 28-2 from excessive bending and buckling.

In use, in a preferred embodiment, when the outer section 54 is extended, the first threaded driving rod 26-1 and the first gas strut 28-1 act in concert in an upward direction on the top cap 60. As noted, the top cap 60 is bolted to the outer section 54, which supports the platform 16 (and the operator). An opposing force is supported by the gear box 62 and is transferred to the middle section 56 via suitable connections (e.g., bolted connections). The middle section 56 thus acts as a support section as the outer section 54 is being extended.

After the outer section 54 has been raised/extended to a maximum position or when the friction between the first threaded driving rod 26-1 and the primary nut 68 exceeds the corresponding friction at the second threaded driving rod 26-2, the rotary power by the drive link 72 is transferred to the second threaded driving rod 26-2 by the power transfer belt 76. The second gas strut 28-2 and the second threaded driving rod 26-2 act on the gear box housing 62 to extend/elevate the middle section 56. The reaction forces are placed on the support section 58 and then are transferred to the ground via the machine base. At this point, the middle section 56 is the extending section and the support section 58 provides support for the lifting components acting on the middle section 56.

Figure 12:
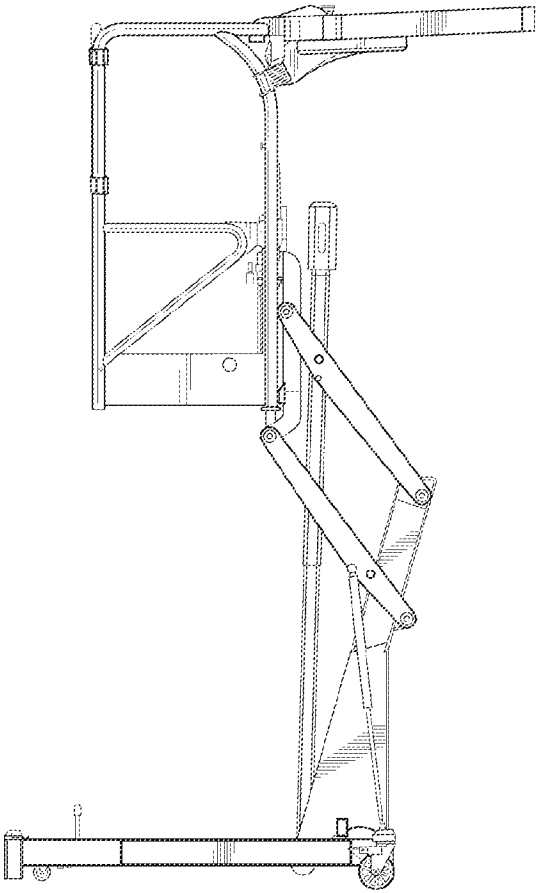
FIGS. 10-12 show an alternative mast lift embodiment using a double linkage parallelogram assembly.
Figure 11:
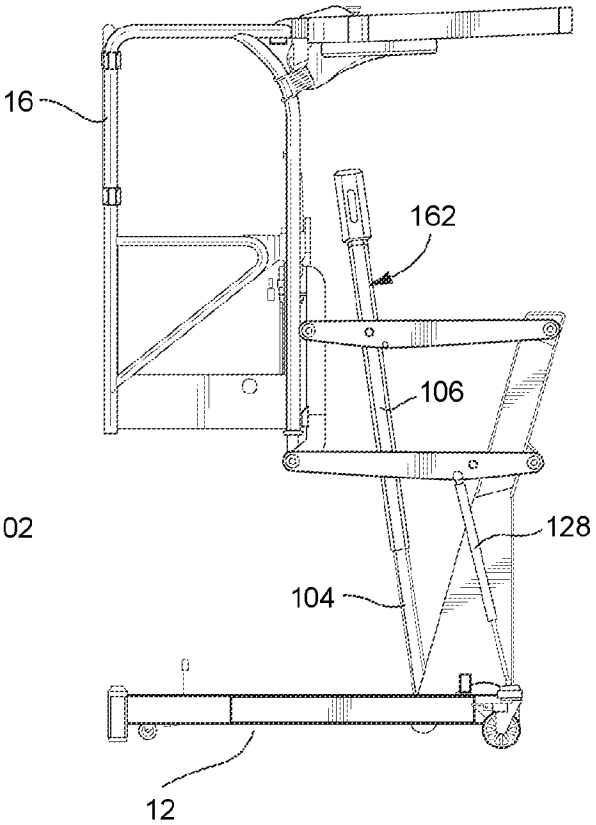
Figure 10:
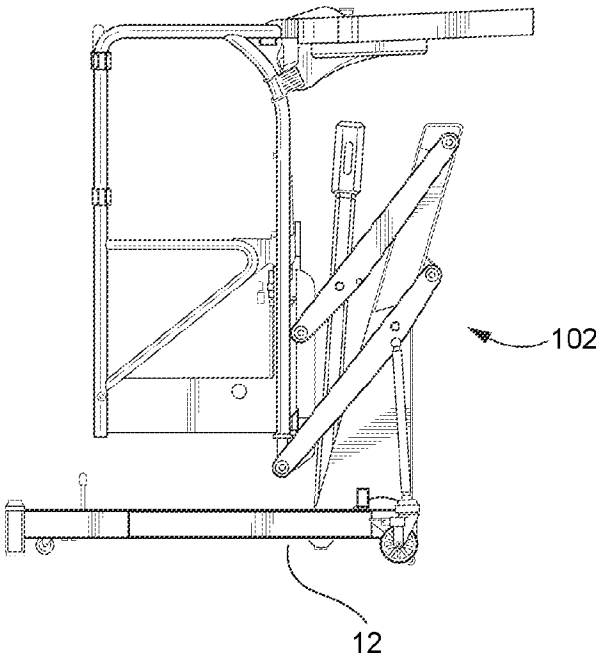
Figure 13:
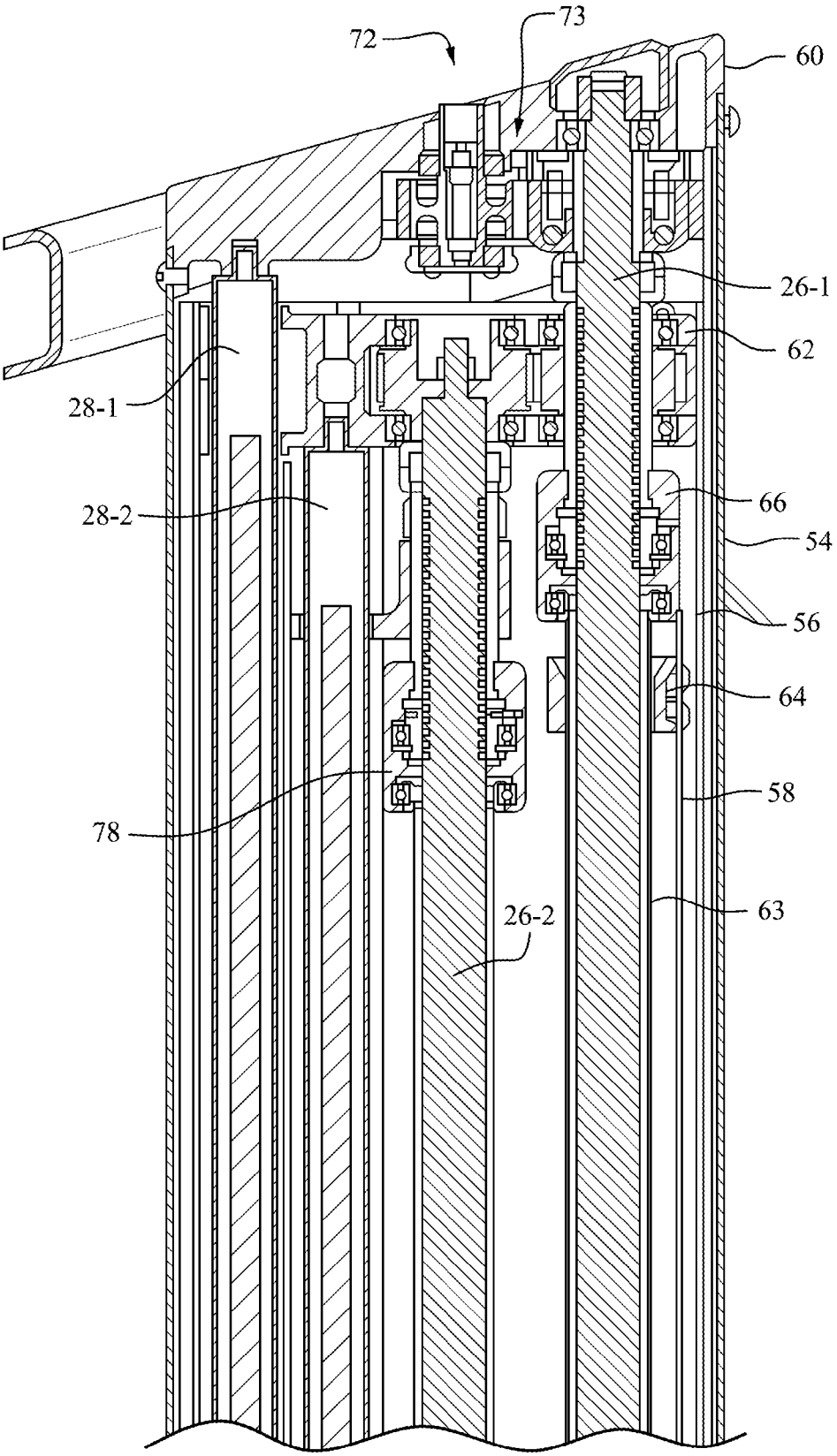
FIGS. 13-18 are sectional views of the lift mechanism operating components.
Figure 14:
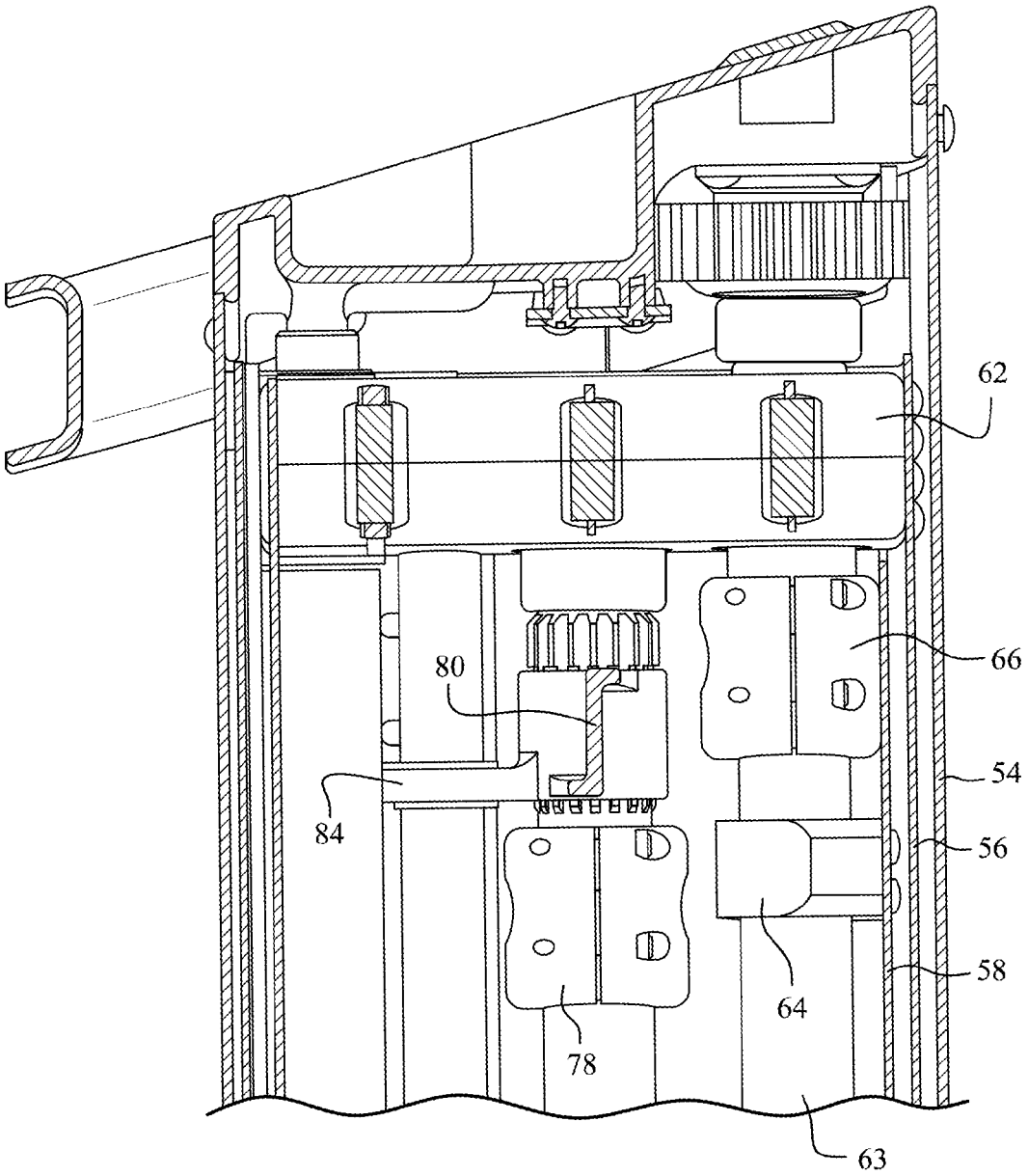

FIGS. 10-12 show an alternative embodiment of the mast lift. Instead of a telescoping mast, the lifting assembly includes a double linkage parallelogram assembly 102. In this embodiment, the threaded driving rod 126 includes a base rod 104 coupled to the base 12 and a moving rod 106 coupled to a linkage of the double linkage parallelogram assembly 102. The moving rod 106 is linearly displaceable relative to the base rod 104 by relative rotation between the base rod 104 and the moving rod 106. The gas strut 128 is connected between the base 12 and a linkage of the double linkage parallelogram assembly 102 as shown.

In use, after entering the platform 16, an operator engages the threaded driving rod 126 with a hand-held power drill. As the rod is rotated, the moving rod 106 is displaced linearly relative to the base rod 104, which causes the double linkage parallelogram assembly 102 to extend from the position shown in FIG. 10 toward the positions shown in FIGS. 11 and 12. The gas strut 128 facilitates lifting the platform 16.

The lightweight construction of the described embodiments provides the functionality of a ladder with added advantages. An operator can maintain two hands for working, with space for supporting tools and materials. The powered lift facilitates operator use and increases operator comfort. The platform provides added safety and maintains the operator center of gravity well inside a tipping line. This structure avoids typical set up and climb up risks of scaffolding.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A mast lift comprising:

a base;

a telescoping mast coupled with the base and extending upward from the base, the telescoping mast including a support section fixed to the base, a middle section displaceable relative to the support section, and an outer section displaceable relative to the support section and the middle section;

a top cap secured to the outer section;

a platform supported by the top cap and the outer section;

a gear box secured to the middle section;

a first gas strut secured at one end to the middle section and acting between the middle section and the outer section and biasing the outer section toward an extended position;

a first threaded driving rod connected between the outer section and the middle section and extending through a first fixed nut assembly;

a second gas strut secured between the gear box and the support section; and a second threaded driving rod connected between the gear box and the support section and extending through a second fixed nut assembly, wherein the gear box comprises a power transfer belt connected between the first threaded driving rod and the second threaded driving rod, and wherein rotary power applied to the first threaded driving rod is transferred to the second threaded driving rod by the power transfer belt according to a path of least resistance.

2. A mast lift according to claim 1, further comprising a drive link coupled with the first threaded driving rod, the drive link receiving a rotary power source to rotate the first threaded driving rod.

3. A mast lift according to claim 2, wherein the drive link comprises a socket for receiving a complementary bit of a hand-held power drill.

4. A mast lift according to claim 1, wherein the first fixed nut assembly comprises a housing and a nut disposed in the housing, wherein the first threaded driving rod is threaded through the nut.

5. A mast lift according to claim 1, wherein the second threaded driving rod is anchored to the base through the support section.

6. A mast lift comprising:

a base;

a telescoping mast coupled with the base and extending upward from the base, the telescoping mast including a support section fixed to the base, a middle section displaceable relative to the support section, and an outer section displaceable relative to the support section and the middle section;

a top cap secured to the outer section;

a platform supported by the top cap and the outer section;

a gear box secured to the middle section;

a first gas strut secured at one end to the middle section and acting between the middle section and the outer section and biasing the outer section toward an extended position;

a first threaded driving rod connected between the top cap and the middle section and extending through a first fixed nut assembly;

a second gas strut secured between the gear box and the support section; and a second threaded driving rod connected between the gear box and the base and extending through a second fixed nut assembly, wherein the first fixed nut assembly and the second fixed nut assembly each comprises a housing and a nut disposed in the housing, wherein the first and second threaded driving rods are threaded through the nuts, respectively.

7. A multi-section mast lift comprising:

a base;

a telescoping mast supported on the base, the telescoping mast including a support section secured to the base, at least one middle section cooperable with the support section and displaceable relative to the support section between a retracted position and an extended position, and an outer section cooperable with a topmost one of the at least one middle section and displaceable relative to the topmost one of the least one middle section between a retracted position and an extended position;

a top cap secured to the outer section;

a platform supported by the top cap and the outer section;

a gear box secured to the at least one middle section; and a lifting assembly for displacing the outer section and the at least one middle section between the retracted and extended positions, the lifting assembly including a threaded driving rod and a gas strut for each of the outer section and the at least one middle section, wherein the threaded driving rods are driven by rotating a single drive link cooperable with the lifting assembly.

* * * * *